United States Patent [19]

Friese

[11] 3,954,497

[45] May 4, 1976

[54] HYDROLYSIS OF DECIDUOUS WOOD

[75] Inventor: Hermann Friese, Berlin, Germany

[73] Assignee: Sud-Chemie A.G., Munich, Germany

[22] Filed: Nov. 13, 1974

[21] Appl. No.: 523,455

[30] Foreign Application Priority Data

Nov. 23, 1973 Germany ..... 2358407

[52] U.S. Cl. ..... 127/37; 260/124 R; 260/635 C

[51] Int. Cl.[2] ..... C13K 13/00

[58] Field of Search..... 127/37; 260/124 R, 124 A, 260/635 C

[56] References Cited

UNITED STATES PATENTS

| | | | |
|---|---|---|---|
| 2,801,955 | 8/1957 | Rutenberg | 127/37 X |
| 2,835,611 | 5/1958 | Snyder | 127/37 |
| 3,212,933 | 10/1965 | Hess | 127/37 |
| 3,251,716 | 5/1966 | Porter | 127/37 |
| 3,565,687 | 2/1971 | Suminoe | 127/37 |
| 3,784,408 | 1/1974 | Jaffe | 127/37 |
| 3,787,241 | 1/1974 | Eickemeyer | 127/37 |
| 3,817,826 | 6/1974 | Nygard | 260/124 A |

*Primary Examiner*—Morris O. Wolk
*Assistant Examiner*—Sidney Marantz
*Attorney, Agent, or Firm*—Watson Leavenworth Kelton & Taggart

[57] ABSTRACT

A process for the hydrolysis of deciduous wood wherein the hydrolysis is carried out in a first stage with an alkali metal hydroxide solution of concentration less than 4 percent by weight and in a second stage with mineral acid. A resulting product, D-(+)-xylose, can be recovered as such or converted directly to xylitol. The process also provides for the convenient recovery of lignin and cellulose present in the wood.

23 Claims, No Drawings

HYDROLYSIS OF DECIDUOUS WOOD

BACKGROUND OF THE INVENTION

1. Field of the Invention

This invention relates to methods for hydrolyzing wood to provide D-(+)-xylose.

2. Description of the Prior Art

D-(+)-xylose and its hydrogenation product, xylitol, are of considerable industrial importance. For example, xylose can be employed for various purposes in the foodstuffs industry, while xylitol has proved to be a very good sweetener for diabetics.

It is known to hydrolyze deciduous wood with mineral acid, for example, hydrochloric acid or sulphuric acid, under normal pressure or under super-atmospheric pressure (compare, for example Austrian patent 266 865 and British patent 922 685). A xylose yield of only approximately 10 to 12 percent is obtained. Furthermore, the material which remains, so-called cellolignin, cannot be utilized.

The so-called saccharification of wood is also known (compare, for example, DT-PS 1 183 870, German Offenlegungsschrift 1 567 335, 1 567 350 and 1 642 534), but hitherto this method has hardly been utilized industrially. In the saccharification process, the lignin remains as a non-utilizable brown insoluble product. A further disadvantage of this process is that the acetic acid which is chemically bonded in the wood (about 6 percent) is split off during the hydrolysis of the pentosan and interferes with the neutralization of the mineral acid required for this process, so that considerable consumption of ion exchangers becomes necessary. Furthermore, materials also pass into the hydrolysis solution which interfere with the hydrogenation of the xylose to xylitol, thereby lowering the yield of the latter and requiring that a careful prior purification be carried out.

Accordingly, there is a need for a process for the hydrolysis of deciduous wood which, firstly, permits complete utilization of the starting material and, secondly, gives a higher yield of xylose, thus rendering the process economical.

SUMMARY OF THE INVENTION

The subject of the instant invention is a process for the hydrolysis of deciduous wood, characterized in that the hydrolysis is carried out in a first stage with an alkali metal hydroxide solution of concentration less than 4 percent by weight and in a second stage in a manner known per se with mineral acid. A resulting product, D-(+)-xylose, can be recovered as such or converted directly to xylitol. The aforesaid process also provides for the convenient recovery of lignin and cellulose present in the wood.

The first stage of the process according to the invention results in the splitting off of the chemically bonded acetic acid, which goes into solution as alkali metal acetate, and in the dissolution of materials of lignin-like nature, which would otherwise interfere with the subsequent isolation of the xylose, following the second stage according to the invention. While it is known to obtain hemicelluloses by extracting deciduous wood with 4 percent strength NaOH (compare, for example, Nikitin, Die Chemie des Holzes, (The Chemistry of Wood) 1955, page 199), the hemicelluloses go into solution and are then difficult to separate from the acetic acid and the lignin-like materials. If, on the other hand, in accordance with the first stage of the process according to this invention, the reaction is carried out with an alkali metal hydroxide solution of less than 4 percent strength by weight, the pentosan is not dissolved and can instead be separated as part of the residue, from the solution which contains the alkali metal acetate and the lignin-like materials.

The process according to the invention starts from deciduous wood, such as wood from beeches, birches, poplars, elms, willows, elders, ashes or yews, with beechwood and birchwood being preferred. These have an average content of 23 to 25 percent of pentosans which mainly consist of xylan.

The first stage of the process according to the invention preferably uses sodium hydroxide or potassium hydroxide, but especially sodium hydroxide, as the alkali metal hydroxide. The alkali metal hydroxide concentration in the solution should be less than 4 percent by weight, preferably less than 3 percent by weight, and especially 0.5 to 2 percent by weight. For example, 0.7 to 1.2, and especially 1, percent by weight is used. The amount of alkali metal hydroxide solution used is such as to provide 1.33 to 2 mols of alkali metal hydroxide per 1 mol of acetic acid chemically bonded in the wood. The temperature used in the first stage of the process is not of great importance and this stage can be carried out at between room temperature and the boiling point of the alkali metal hydroxide solution. It can be carried out under atmospheric pressure, superatmospheric pressure not being necessary. Water is preferably used as the solvent.

During the first stage of the process, a little hydrogen peroxide, totalling 7 to 12 percent by weight, preferably 10%, based on the dry weight of the wood, can be added in portions.

At the end of the first stage of the process, the liquid is separated from the solid residue. Working up of the weakly alkaline liquid shows that the latter does not contain any pentosan but does contain the entire acetic acid initially present chemically bonded in the deciduous wood, as alkali metal acetate. After the liquid phase has been brought to the alkali metal hydroxide concentration to be used according to the invention, by adding alkali metal hydroxide, it can be reused in the first stage of the process according to the invention and can thus become enriched with alkali metal acetate through repeated use so that isolation of the acetic acid from the solution then appears promising.

In the second stage of the process according to the invention, the residue from the first stage, which contains pentosan and cellolignin, is further hydrolized with mineral acid at elevated temperature, optionally being super-atmospheric pressure.

Here it is possible to use, for example, $H_2SO_4$, HCl or HBr, for example in water, $H_2SO_4$ being preferred. When working without pressure, preferably 1.5 to 6.0 percent strength by weight HCl or HBr, or 1.5 to 6 percent strength by volume $H_2SO_4$, and a ratio of liquid to solid of 3 to 6 parts of volume, is preferentially used. Elevated temperatures are used, these being preferably 50° to 125°C, in which case about 2 to 4 hours are required for the second stage of the process according to the invention.

When working under pressure, the preferred pressure is up to 4 atmospheres gauge, especially 1 to 3 atmospheres gauge, for which the temperature is preferably 125° to 135°C. The acid concentration is preferably 0.2 to 0.6 percent by weight of HCl or HBr, or 0.2 to 0.6 percent by volume of $H_2SO_4$. The ratio of liquid to solid should preferably be 4:1 to 7:1 parts by volume/weight of solids. The time required is approximately 1 to 2 hours.

After completion of the second stage of the process, the batch is filtered. The liquid can be worked up to xylose or directly to xylitol. If sulphuric acid has been used in the second stage, neutralization can be carried out with calcium oxide, calcium carbonate or preferably with barium carbonate, in the calculated amount. In that case, after removing the precipitate, a xylose solution which can be reduced directly to xylitol is obtained, while hitherto it has been necessary to concentrate the solution or pass it over ion exchangers, to remove the acetic acid. The yield of xylose is substantially higher than in the processes hitherto known.

The insoluble residue from the second stage of the process according to the invention can next be used to obtain lignin, by extracting the residue with organic solvents, such as methanol or acetone. The solution from this extraction then contains the lignin, which is isolated by evaporation. A non-polymerized lignin is obtained, which is thermoplastic and very reactive; the material can be used as a base material for dyestuffs and pesticides.

The residue which remains after the treatment with the organic solvent can be converted to cellulose. Here it is not necessary, as has hitherto been customary and necessary, to work at high temperature and under pressure. Instead, it suffices to subject the extraction residue to a treatment with alkali metal chlorite and subsequently with alkali metal hydroxide, thereby providing a practically white cellulose which can be used for various industrial applications.

In the treatment with alkali metal chlorite solution, elevated temperature is used and preferentially sodium chlorite but potassium chlorite also, can be used. The concentration of alkali metal chlorite in the alkali metal chlorite solution can be up to 12, and preferably 10, per cent by weight. The temperature is preferably 60° to 75°C and the pH value is 3 to 5, preferably 3.5. It is not necessary to use pressure. The treatment with alkali metal chlorite is carried out for approximately 1 hour and must be repeated if necessary. After removing the alkali metal chlorite solution and briefly washing the residue, if necessary, the latter is then treated with alkali metal hydroxide solution at elevated temperature. For example, sodium hydroxide or potassium hydroxide, but preferably sodium hydroxide, can be used; the alkali metal hydroxide concentration in the solution is 2 to 4, preferably 2.4, percent by weight. The temperature is preferably 60° to 75°C and the reaction time is usually 40 to 60 minutes. It is not necessary to use pressure. A practically white cellulose is thus obtained.

EXAMPLE 1

1. 1,000 g of coarse beechwood flour (calculated as solids) are treated, at room temperature, with 8 l of a 1 percent strength aqueous sodium hydroxide solution (80 g of NaOH). The batch is stirred for 10 minutes and then titrated, during which it is found that practically 40 g of NaOH have been consumed, corresponding to the content of chemically bound acetic acid in the wood. Thereafter, the batch is additionally heated for 30 to 60 minutes to 70°–90°C on a water bath. The NaOH consumption is now approximately 55–60 g.

The dark brown solution is filtered off and the residue is washed with $H_2O$ until there is no further alkaline reaction.

After acidifying the filtrate with dilute $H_2SO_4$, a precipitate of approximately 20 g is obtained, which does not contain any xylan but does contain 18 percent of $—OCH_3$ and proves to be soluble lignin. The acid solution is now evaporated in vacuo until it is a mobile syrup. The distillate contains 60 g of acetic acid (corresponding to 42 g of chemically bonded acetyl in the wood employed).

The syrup is neutralized with $CaCO_3$ to bind the sulphuric acid and is then treated with methanol, which after evaporation leaves a dark brown substance, weighing approximately 90 g, which is soluble in various organic solvents and does not contain any xylose but does contain 10.9 percent of $—OCH_3$ groups. This substance is very reactive.

2. The wood residue amounts to approximately 849 g and contains 28 percent of xylan. It is stirred with a 5-fold to 7-fold amount by volume of 0.5 percent strength by volume aqueous sulphuric acid for 2 hours in an autoclave at 2 to 2.5 atmospheres gauge at 125° to 132°C. The residue is filtered off and washed well with water, and the filtrate is neutralized with the calculated amount of $CaCO_3$ or $BaCO_3$. In contrast to the customary hydrolysis solutions, the solution obtained is very light in color and free from acetic acid. Only very small amounts of active charcoal are necessary for its decolorization. After concentrating the solution, hydrogenation can be carried out immediately, without isolating the xylose. However, because of the presence of D-glucose and small amounts of other sugars (for example mannose, L-arabinose and L-rhamnose) it is recommended first to crystallize out the xylose, which gives a xylose yield of up to 16 percent, calculated relative to the wood material originally employed.

However, the hydrolysis solution can also be freed from the hexoses by fermentation (Methods in Carbonhydrate (sic) Chemistry, vol. I, page 88).

3. The residue from the acid hydrolysis amounts to approximately 635 g and still contains 7–9 percent of sparingly soluble xylan.

2–3 percent of soluble lignin are obtained from this residue by treatment with methanol.

4. 618 g of residue from the methanol treatment are mixed with 55 g of $NaClO_2$ dissolved in 4–5 l of $H_2O$. The mixture is acidified to a pH value of 3.5. It is then warmed at 60° to 65°C for 1 hour with gentle stirring and the process is repeated if necessary. After filtration, and brief washing with water, the light yellow residue is heated with 4 to 5 l of 2.4 percent strength sodium hydroxide solution at 65° to 70°C for 40–60 minutes. After filtration and washing with water, 422 g of practically white cellulose, containing less than 1 percent of $—OCH_3$, and about 9 percent of xylan, remain.

EXAMPLE 2

1. 100 g of coarse beechwood flour (calculated as solids) are mixed with 600 ccs of a 1.33 percent strength aqueous sodium hydroxide solution (8g of NaOH). The batch is warmed to 50°–65°C on a water bath for 60 to 90 minutes; at the same time, 10 ccs of $H_2O_2$ solution (35 percent strength) are allowed to run in, in small portions.

After completion of the reaction, the mixture is filtered and the residue is rinsed with water. This leaves 81.5 g of a light yellowy substance which contains 30.1 percent of xylan and 5.7 percent of —$OCH_3$ groups.

The filtrate is worked up as in Example 1. The acetic acid content of the wood is found to be approximately 6 percent.

Because of the oxidative action of the hydrogen peroxide, the products isolated from the filtrate only have similar properties to the products isolated from the filtrate of Example 1. However, they also do not contain any xylan. It is possible to reuse the filtrate again so as to accumulate acetic acid therein.

2. The residue of 81.5 g from the alkali metal hydroxide treatment is heated with 400 ccs of 4 percent strength by volume aqueous sulphuric acid for 2 hours under atmospheric pressure in an oil bath at 130°–135°C. It is filtered off and rinsed with water, the light yellow solution is neutralized with the calculated amount of $CaCO_3$ and concentrated in vacuo, and methanol is added to the concentrate until it becomes turbid, with remnants of calcium salts precipitating. After further concentration in vacuo to give a mobile syrup, the latter is left to crystallize. Approximately 16 g of pure xylose are obtained.

EXAMPLE 3

1. 200 g of coarse birchwood flour (calculated as solids) are stirred with 2 l of 1 percent strength by weight of aqueous sodium hydroxide solution (20 g of NaOH) (1 cc of the solution corresponds to 2.48 ccs of N/10 HCl) for 10 minutes at room temperature. Thereafter, the titre of 1 cc of solution is 1.2 ccs of N/10 HCl. After leaving the batch to stand for 6 hours, the titre of 1 cc of the solution is 0.9, and after 30 minutes heating to 65° to 70°C, the titre is 0.85, cc of N/10 HCl. Thus, 13.2 g of NaOH are consumed; 8 g of NaOH are required for splitting off the acetyl group.

After filtration, washing with $H_2O$ and drying, approximately 170 g of residue, containing 18.8 percent of xylan and 7.7 percent of —$OCH_3$, are left.

Approximately 12 g of acetic acid and a little formic acid can be isolated from the filtrate. On precipitation with dilute sulphuric acid and working up as in Example 1, 2 soluble fractions of (a) 3.2 g, containing 0 percent of xylose and 8.1 percent of —$OCH_3$, and of (b) approximately 15 g which is also free from xylose and contains 15 percent of —$OCH_3$ groups are isolated.

2. The 170 g of residue are heated with 1 l of 4 percent strength by volume aqueous sulphuric acid for 2½ hours under reflux at 130° to 135°C oil bath temperature. The residue is filtered off, the calculated amount of $CaCO_3$ or $BaCO_3$ to give a pH value to 3 is added to the light yellowish-greenish solution, and the solution is concentrated in vacuo and left to crystallize. 16 percent of xylose, calculated relative to the starting material, are obtained.

3. The residue from the acid hydrolysis weighs approximately 120 g and contains 8–10 percent of xylan. It is treated with 12 g of $NaClO_2$, dissolved in 1 l of $H_2O$, for 60 minutes at 65° to 70°C and the process is repeated if appropriate. The residue from this treatment is treated with 350 to 500 ccs of 2.4 percent strength by weight aqueous sodium hydroxide solution at 70°C. 84 g of an almost white cellulose product which contains 9–10 percent of xylan and less than 1 percent of —$OCH_3$ groups are obtained.

What is claimed is:

1. A process for the hydrolysis of deciduous wood which comprises:

a. hydrolyzing deciduous wood with an alkali metal hydroxide solution having a concentration of less than 4 percent by weight, to provide a deciduous wood from which the chemically bound acetic acid therein has been substantially completely removed, said acetic acid being then present in solution as alkali metal acetate;

b. recovering the deciduous wood from which the chemically bound acetic acid has been substantially removed; and c. hydrolyzing the deciduous wood of step (b) with a mineral acid to provide a solid residue containing lignin and an acidic solution of D-(+)-xylose.

2. The process of claim 1 wherein the solid residue containing lignin is separated from the acidic solution of D-(+)-xylose, the residue is extracted with organic solvent to remove the lignin therefrom and the remaining residue is at elevated temperature first treated with alkali metal chlorite, followed by treatment with alkali metal hydroxide solution to provide cellulose.

3. The process of claim 1 wherein the D-(+)-xylose present in the acid solution of step (c) is recovered therefrom in substantially pure form.

4. The process of claim 1 wherein the said employed in hydrolysis step (c) is sulphuric acid, the acidic solution of D-(+)-xylose is neutralized with calcium oxide, calcium carbonate or barium carbonate and the xylose is thereafter reduced in situ to provide xylitol.

5. The process of claim 4 wherein the xylitol is recovered from solution in substantially pure form.

6. The process of claim 2 wherein the lignin-containing residue is extracted with methanol or acetone.

7. The process of claim 2 wherein the lignin is recovered from the extract solution thereof in substantially pure form.

8. The process of claim 1 wherein hydrolysis step (a) is carried out with a solution of sodium hydroxide, potassium hydroxide, or combination thereof.

9. The process of claim 8 wherein the solution is an aqueous solution.

10. The process of claim 1 wherein hydrolysis step (a) is carried out with an alkali metal hydroxide solution of less than 3 percent by weight.

11. The process of claim 10 wherein the alkali metal hydroxide solution is 0.5 to 2 percent by weight.

12. The process of claim 1 wherein hydrolysis step (a) is carried out in the presence of hydrogen peroxide.

13. The process of claim 12 wherein the hydrogen peroxide is present in an amount of about 10 percent by weight based on the dry weight of the wood.

14. The process of claim 1 wherein hydrolysis step (a) is carried out at room temperature up to the boiling point of the alkali metal hydroxide solution.

15. The process of claim 2 wherein the alkali metal chlorite is sodium chlorite or potassium chlorite.

16. The process of claim 2 wherein an alkali metal chlorite solution having an alkali metal chlorite concentration up to 12 percent by weight is employed.

17. The process of claim 16 wherein the alkali metal chlorite concentration of said chlorite solution is 10 percent by weight.

18. The process of claim 2 wherein an alkali metal chlorite solution having a pH of 3 to 5, at a temperature of 60° to 75°C. is employed.

19. The process of claim 18 wherein the pH is 3.5.

20. The process of claim 2 wherein a 2 to 4 percent by weight alkali metal hydroxide solution is employed.

21. The process of claim 20 wherein a 2.4 percent by weight solution is employed.

22. The process of claim 2 wherein the treatment with alkali metal hydroxide solution is carried out at 60° to 75°C.

23. The process of claim 1 wherein the amount of alkali metal hydroxide solution is such as to provide from about 1.33 to 2 mols of alkali metal hydroxide per mol of acetic acid chemically bonded in the wood.

* * * * *

UNITED STATES PATENT OFFICE

CERTIFICATE OF CORRECTION

PATENT NO. : 3,954,497

DATED : May 4, 1976

INVENTOR(S) : Hermann Friese

It is certified that error appears in the above-identified patent and that said Letters Patent are hereby corrected as shown below:

Col. 2, line 53, "being super-atmospheric" should read --using super-atmospheric--.

Col. 6, line 24, (Claim 4), "said employed" should read --acid employed--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*